United States Patent [19]

Charney et al.

[11] Patent Number: 4,537,522

[45] Date of Patent: Aug. 27, 1985

[54] PAINT DISPENSING APPLICATOR WITH SAFETY FEATURES

[75] Inventors: Joseph C. Charney; Phillip M. Goodman; Robert H. Morgan, all of Milwaukee, Wis.

[73] Assignee: EPR Corporation, Danville, Calif.

[21] Appl. No.: 509,687

[22] Filed: Jul. 1, 1983

Related U.S. Application Data

[63] Continuation-in-part of Ser. No. 344,545, Feb. 1, 1982, Pat. No. 4,422,789, and a continuation-in-part of Ser. No. 193,001, Oct. 2, 1980, abandoned.

[51] Int. Cl.[3] ..... B43M 11/02

[52] U.S. Cl. ..... 401/218; 401/146; 401/149; 401/188 R; 401/197

[58] Field of Search ..... 401/218, 197, 188 R, 401/146, 149

[56] References Cited

U.S. PATENT DOCUMENTS

| | | | |
|---|---|---|---|
| 2,419,338 | 4/1947 | De Marco | 401/147 |
| 2,606,334 | 8/1952 | Vaden et al. | 401/197 |
| 3,030,652 | 4/1962 | Whitfield et al. | 401/218 |
| 3,320,630 | 5/1967 | Furlong | 401/147 |
| 3,457,017 | 7/1969 | Bastian | 401/197 X |
| 3,549,267 | 12/1970 | Wurzer et al. | 401/197 X |
| 3,620,633 | 11/1971 | Charvoz | 401/147 |
| 3,977,797 | 8/1976 | Paterson | 401/197 X |
| 4,140,410 | 2/1979 | Garcia | 401/150 |
| 4,175,300 | 11/1979 | McGlew et al. | 401/197 X |
| 4,217,062 | 8/1980 | Trp et al. | 401/197 X |
| 4,231,668 | 11/1980 | Groth et al. | 401/197 X |
| 4,302,122 | 11/1981 | Moya | 401/197 X |
| 4,422,789 | 12/1983 | Charney et al. | 401/218 |

FOREIGN PATENT DOCUMENTS

| | | | |
|---|---|---|---|
| 173238 | 11/1952 | Austria | 401/197 |
| 471452 | 2/1951 | Canada | 401/197 |
| 40642 | 8/1965 | German Democratic Rep. | 401/218 |
| 672738 | 5/1952 | United Kingdom | 401/197 |
| 918902 | 2/1963 | United Kingdom | 401/197 |

*Primary Examiner*—Steven A. Bratlie

*Attorney, Agent, or Firm*—Shoemaker and Mattare, Ltd.

[57] ABSTRACT

A fluid applicator includes a fluid applicator roller engaged with a fluid dispersing roller. The fluid dispersing roller includes a pair of helical fluid dispersing troughs which receive fluid from an electric motor driven pump which is operated by a low voltage electric switch control located on a handle of the fluid applicator.

24 Claims, 15 Drawing Figures

FIG. 3.
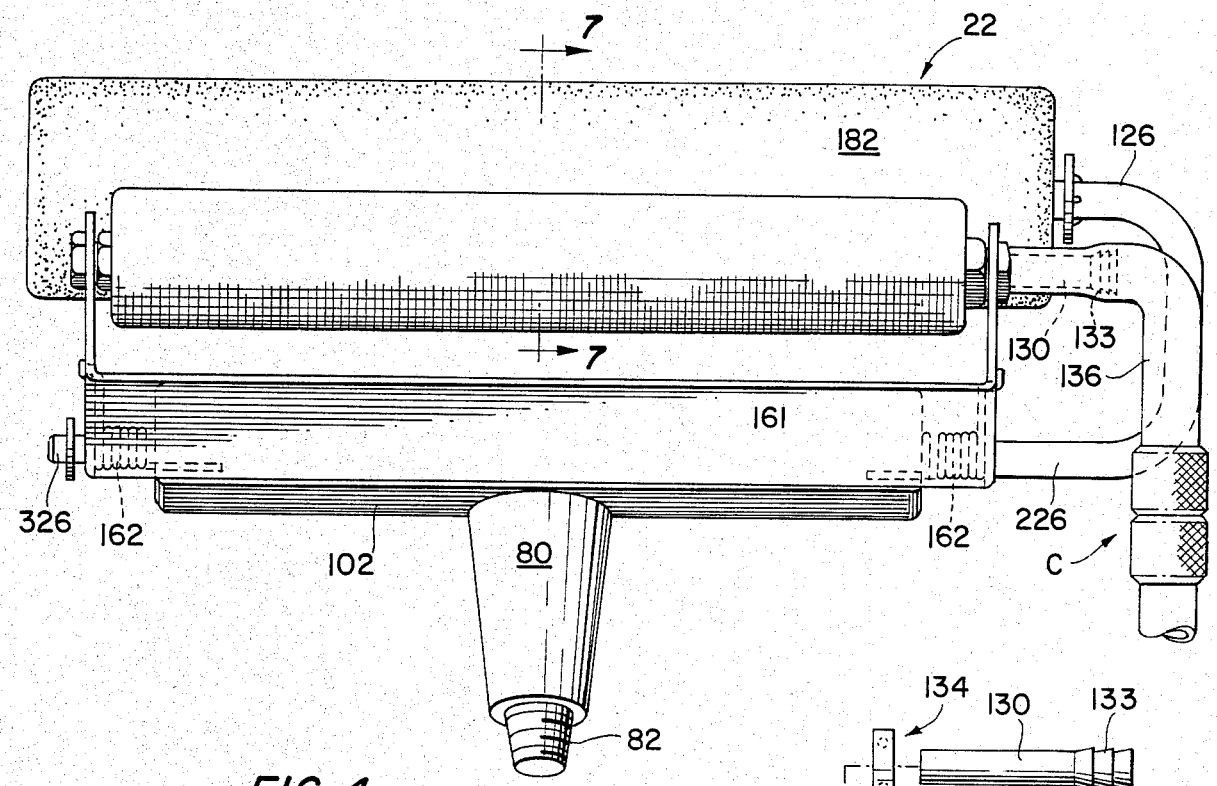
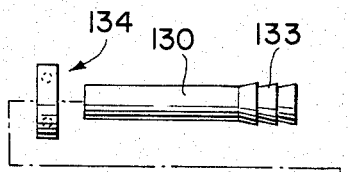
FIG. 4.
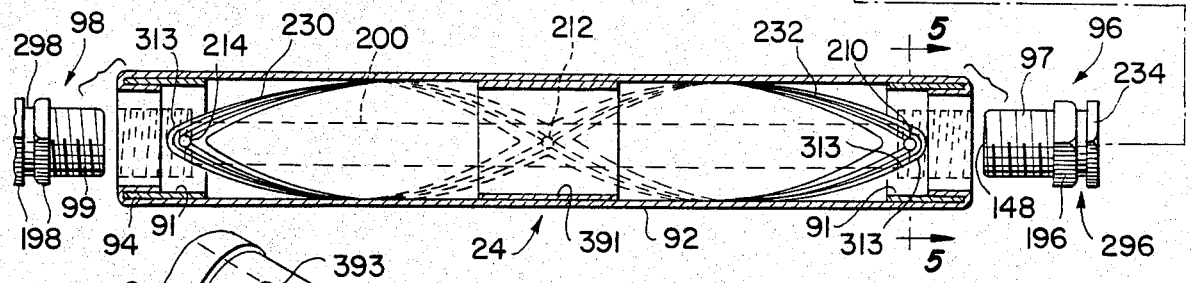
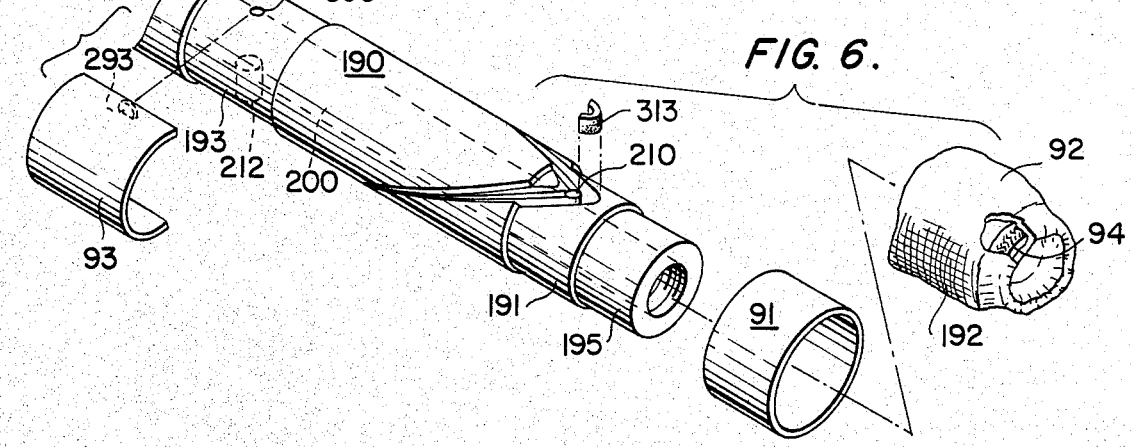
FIG. 6.

PAINT DISPENSING APPLICATOR WITH SAFETY FEATURES

Present application is a C.I.P. of application Ser. No. 344,545 filed 2/1/82 now U.S. Pat. No. 4,422,789 and a C.I.P. of Ser. No. 193,001 filed 10/02/80 now abandoned.

BACKGROUND OF THE INVENTION

The present invention relates in general to fluid applicators, and, more particularly, to roller-type paint applicators.

There are many situations wherein a fluid is to be applied to a surface. Chief among these situations is that of applying paint, shellac, stain or the like to exterior or interior surfaces, or to textiles, or the like.

The above-mentioned painting procedures are often carried out using roller-type paint applicators.

A serious problem associated with such paint applicators is created by a necessity to stop the paint applying step to dip the roller into a paint container at various times during the process.

This problem of interrupted liquid application has engendered several inventive devices, such as those described in U.S. Pat. Nos. 2,419,338, 3,320,630, 3,620,633 and 4,140,410. These devices often do not apply the paint to the roller applicator evenly, have multi-holed, complicated fluid structure, and are hard to take apart and put together, which causes clogging, and thus creates a potential for a blotchy application of paint.

Another problem with known type prior art devices is that the pressure pump must be of relatively large horsepower and create high pounds per square inch pressure in order to force paint flow, and when electrically operated pumps are used, a chance of danger to an operator through electrocution or the like is possible because known devices generally operate at full line voltage and current. Other known devices fail to provide adequate and changeable paint shields to prevent indiscriminate splatter of paint.

SUMMARY OF THE INVENTION

The device embodying the teachings of the present invention can be used to evenly apply fluid, such as paint, or the like, to a surface without stopping to dip a roller into a container of that fluid.

The device includes a carriage on which a handle and a pair of contacting rollers are supported. An electric motor driven pump is mounted on a portable base unit having a source of fluid to be applied and is controlled by a low voltage electric switch on the handle.

One of the rollers is a paint applicator roller and one of the rollers is a paint source feed roller. The paint source feed roller has a pair of helical fluid troughs fluidly connected to dispersement holes to receive fluid from transfer passages connecting those holes to a fluid passage extending axially of the feed roller. Fluid from the paint source is pumped through a flexible hose to the axial passage in the feed roller. The paint feed roller is an idler-type roller which is turned via frictional engagement with the paint applicator roller which is caused to rotate as that roller moves over a surface to which the paint is being applied. The fluid flows through a double-ply porous cover mounted on the feed roller over the helical troughs and deflector sleeves over the dispersement holes. The cover comprises a two or more ply sleeve with the exterior ply being of harsh or coarse material and the inner ply being closely woven using flat elastic sewn between the plies which is essential for this design. Though the inventors use two plies, the idea is the same, in that the paint (natural and not thinned) forms a natural seal on the rears of the plies so that there is no dripping from the feed roller, or excess paint from the feed roller to the exterior roller when painting and pump unit is off. The material has to stretch over the feed roller. Thus, paint is evenly applied to the applicator roller.

An important feature of the invention, as disclosed and claimed in applicant's parent C.I.P, application, Ser. No. 344,545 now U.S. Pat. No. 4,422,789, is the closed loop helical troughs with ridge construction. Because of the ridge along and within the lower central area of each closed loop helical trough, paint is flowed evenly and smoothly between the respective ends of the feed roller, and very efficiently saturates the double ply porous cover over the feed roller.

Other important features of the present invention include the pivotably mounted carriage support with extending fingers for support members for the respective ends of the feed roller. These support members have slotted hex nuts thereon to support the feed roller on the pivotably mounted support carriage. The support carriage also has a pair of clips formed therewith for replaceably holding a protective shield therefrom. The shield also may be mounted in a slot in the main body of the applicator device. This slot can be effectively used to hold the shield since the U-frame support for the applicator roller is arranged approximately 15° from the longitudinal plane of the body and handle axis. This arrangement permits the shield to be held by the slot without complicated attaching structure.

The feed roller plugs for each end thereof are unique, and not found in the prior art. They serve multifunctions. The first function is that of a quick dislodgement of the entire feed roller from the pivotal support carriage because of the round bearing shaft which is located in each plug. These serve as bearing surfaces for the feed roller. The second function is for cleanout of the feed roller. Both plugs can be turned by hand, or by using a common house tool such as pliers or a wrench, the left plug by a clamp tool as described along with a common screwdriver as an alternate (see slot on end of plug). The third function is the right plug carries a sealed bearing in which a hollow shaft is inserted for feeding paint to the feed roller. The opposite plug can be opened for cleanout after painting. This is the only plug which needs to be opened for general cleanout.

Another feature is the use of channels versus multiholes because channels are easier to clean, especially if the channels use a minimal amount of feed roller surface. The slip-on, slip-off feed roller sleeve is not tied. It slips onto a shallow groove of the feed roller end which allows the minimum of stretching of the elastic. As time goes on, the elastic becomes less elastic. The shallow groove of the feed roller insures the elastic of a long life. Minimal amount of stretching allows for long life and easy removal.

The use of a standard exterior paint roller, wherein the open ended, left side of the paint roller is not obstructed by an exterior end support, allows the roller to be taken off and washed without unscrewing anything or using clips.

The spring loaded carriage holding the feed roller allows for quick and easy dislodgement of both the exterior paint roller and the feed roller.

The use of the specially designed shield and its container housings is important. The use of two separate insert housings for the paint shield on either the front or the back of the device is essential. The paint roller can be turned around, hence the two shield positions.

Another important feature of the feed roller is in the use of flexible deflecting inserts at the extreme ends of the helical ridge troughs which in conjunction with the deflecting sleeves cause the paint to disperse through the radial traverse holes at each end of the feed roller to flow towards the center of the feed roller. Another half ring sleeve is provided over the central dispersing hole for positively forcing paint flow from the central hole to spread toward both ends of the feed roller along the closed loop helical ridge troughs.

A portable base unit supports and contains an electric motor with centrifugal pump for sucking up paint and the like from a container of same mounted within the base unit. The electric motor is of approximately one-tenth horsepower and operates off conventional 110 to 120 volt A.C. mains. However, as an important safety feature, a relay actuated switch is provided in the base unit for connecting the motor to the 110 to 120 volt line, which relay is in turn operated from a low voltage source of 6 to 24 volts. This is through a stepdown transformer and a flexible extension line from the base unit to a switch on the handle of the applicator device. Thus, a user of the device can be standing in water, on a metal floor, or even immerse the entire applicator in a body of water, such as a swimming pool or the like, without any fear of being electrocuted from the A.C. mains.

Preferably, a speed control device is also provided in the base unit so that the flow of paint can be regulated, and also during cleanup operation a much higher speed of the motor and pump can be effected. The pump itself is provided with a wedging cam member, which together with flexible impeller blades, permits a very low pressure, i.e., five or six pounds per square inch, to be used for pumping the paint.

Another feature of the base unit is in the provision of paint can support blocks which are provided so that partially used paint can can be tilted and the pump input suction pipe having a flattened pickup end can be inserted into the edge corner V created by the tilted can to assure that all of the paint contained therewithin can be used.

A flexible hose is provided with quick disconnect couplings at each end thereof, which can be connected respectively to the input line to the applicator feed roller, and the output line from the centrifugal impeller pump as contained in the portable base unit.

The clean up of this tool is important. Every part is easily accessible. Starting with the floor unit, extension hoses are used so the unit can be placed away from a sink and water so that there will be no chance of electrocution. The water is taken from the sink by a tube to the power unit to the feed roller and provides the overall unit with a continual flush until all the parts are cleaned.

The paint hose leading to the paint roller has a disconnect a short distance from the pump unit. This is to provide an emergency opening in case there is ever a severe clog in the paint line or the pump unit, and the line cannot otherwise be cleaned. Then, the line can be disconnected at this point and the pump allowed to be cleaned out and any excess paint put into a pail at this juncture.

The second reason for a disconnect at this point is that when a cleanout occurs, the paint line can be disconnected here as well as from the feed roller and hung up to dry.

The electric line leading to the pump can be unplugged. The other end is hermetically sealed in the handle switch which stays on the paint line and allows the line to be hung up for drying. The split handle allows the remaining part of the roller head to be cleaned separately.

The pump unit was chosen so that there is a minimal amount of maintenance, and simple removal of the impeller and the insertion of a new impeller is a minimal task for cleaning as well as maintaining the proper function of this tool.

A further feature of the present invention is the arrangement of the frame with removable handle having the pump electric motor switch contained therewithin. This arrangement permits extensions for the handle, of commonly available type, to be inserted between the applicator frame and the operating handle. Therefore, high ceilings, deep bottoms of swimming pools, and the like can be painted by a user of this device with the handle switch always being close for convenient and easy operability thereof.

The applicator device of the present invention can be used to apply paint in regular painting procedures or in applying designs with paint to exterior surfaces, interior surfaces, ceilings or the like. This device can be used for applying stain to wood and designs to textiles. The present applicator can be used with conventional paint rollers for the home market, or may be modified to be elongated to accommodate longer and wider rollers for the commercial market. The device possibly can be applied to paint edgers, or the like.

OBJECTS OF THE INVENTION

It is an object of the present invention to evenly apply fluid to a surface with a roller without requiring the dipping of that roller into a source of fluid.

It is another object or the present invention to evenly apply fluid to an applicator roller in a roller-type paint applicator device, wherein every part is easily accessible for clean-up.

A further object of the present invention is to provide a paint applicator apparatus having electrical safety features for the operator, including a low voltage switch control for the paint feeding pressure source, and a removable and replaceable shield for protection from paint splatter.

Another further object of the present invention is the provision of a portable base unit with electric motor and centrifugal squeezable impeller pump, appropriate motor control electrical wiring, and paint can supporting structure, the pump output being connectabe by a flexible hose with quick connect/disconnect fittings to a double roller applicator device.

Another object and advantage of the present invention is the light weight of the pump and motor in the floor unit, plus the handle being of extremely light weight and thus extremely portable.

A still further object of the present invention is the provision of a pivotably mounted carriage on the applicator body for permitting easy removal and replacement of a feed roller when desired. This pivotable carriage also has clips thereon for holding a protective shield therefrom. A bias spring normally urges the feed roller against the applicator roller. A handle extending from the carriage allows a user to disengage the feed roller from contact with the applicator roller when desired without clips or screws to contend with before lifting out.

Another still further object of the present invention is the provision of a double ply, fine and coarse mesh paint feed roller cover for assuring even paint flow and saturation of the roller cover as installed on the paint feed roller of the apparatus.

These together with other objects and advantages which will become subsequently apparent reside in the details of construction and operation as more fully hereinafter described and claimed, reference being had to the accompanying drawings forming part hereof, wherein like reference numerals refer to like parts throughout.

BRIEF DESCRIPTION OF THE DRAWINGS

FIG. 3 is a plan view of the paint applicator of FIG. 1;

FIG. 4 is a top plan view, partly in cross-section, of the paint feed roller apparatus per se;

FIG. 6 is an exploded perspective view of a portion of the feed roller of FIG. 4;

DETAILED DESCRIPTION OF THE INVENTION

Figure 1:
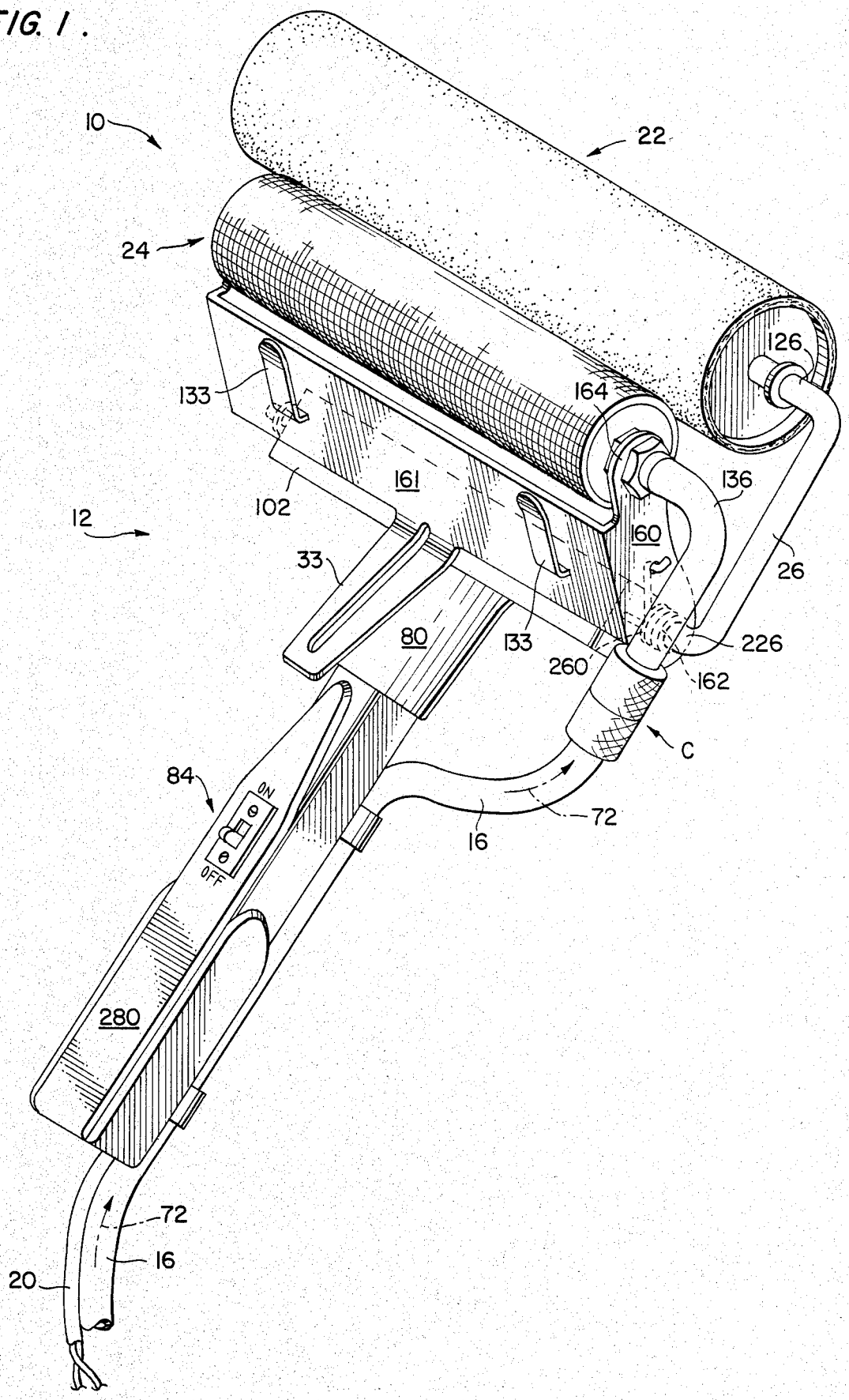
FIG. 1 is a perspective of a paint applicator embodying the teachings of the present invention.
Figure 2:
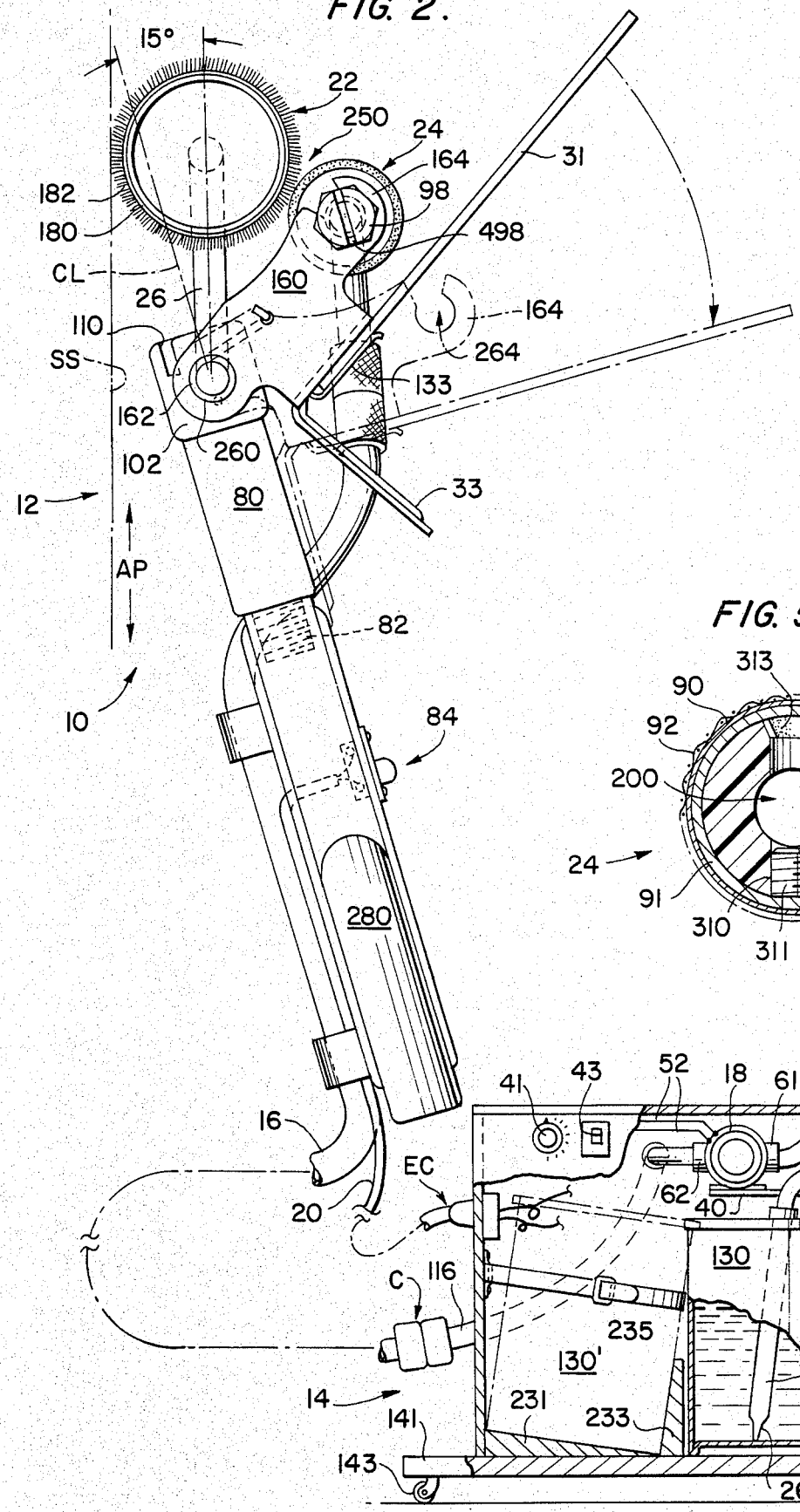
FIG. 2 is a side elevational view of the applicator shown in FIG. 1 together with the paint supply base unit.

Shown in FIGS. 1 and 2 is a fluid paint applicator device 10 embodying the teachings of the present invention. The device 10 includes a main body frame 12 coupled to a fluid paint source 14 by a flexible tube 16 and to an electric pump motor 18 by a cable 20. A roller 22 is a fluid paint applicator roller and has pressed thereagainst a feed roller 24 which is a fluid paint dispersing roller. The feed roller 24 in the preferred embodiment is an idler roller and is rotated by the rotation of the fluid paint applicator roller 22 as that roller is rotated while it moves over a surface to which paint is being applied.

The paint source 14 includes a base unit housing 30 having a lid 32 removably mounted thereon. A mounting frame 36 which includes an L-shaped braaket having a base 40 and a back 42 is affixed within the housing 30. The electric pump motor 18 is mounted on the mounting frame base 40 and includes wires 52 connecting the motor to further power control circuitry.

Figure 8:
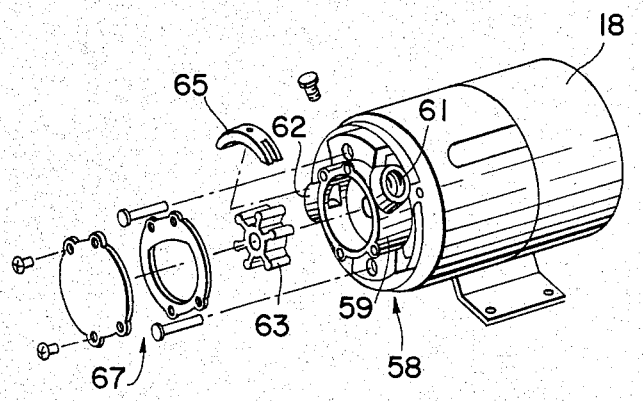
FIG. 8 is an exploded perspective of the electric motor driven impeller pump.

A fluid paint centrifugal pump 58 is mounted on the end of motor 18 (see FIG. 8). The centrifugal pump 58 has a housing 59 with an inlet opening 61 and an outlet opening 62. Mounted for rotation within the central opening of the housing is an impeller 63. Preferably, the impeller 63 has flexible blades and these blades come into direct contact with the cam wedge 65 when each one in turn reaches the upper inside of the pump housing. This provides a squeezing as well as a rotating centrifugal pump action for effecting a pushing flow of the fluid paint. Cover member 67 encloses the impeller and wedge cam structure within the housing. It is because of this arrangement that the low pressure and yet effective fluid paint flow is produced by the electric motor pump of this invention.

FIG. 2 also shows other details of the portable base unit 14 of this invention. The housing 30 is mounted upon a platform 141 supported by rollers 143 for ease of movement thereof. The input 61 of the centrifugal pump 58 is connected to a flexible input hose 361 which in turn has provided on the end thereof an elongated metal pickup tube 461. The end of metal pickup tube 461 has a flattened tip 262. Included within the housing 30, in addition to the flat support for paint can 130, are wedge blocks 231 and 233. These blocks are provided for supporting a partially filled paint can 130'. By so tipping the paint can, the flattened tip 262 of pickup tube 461 can be inserted into the V edge corner at the lowermost portion of the can for maximum utilization of all paint within the can. A strap 235 may be provided to secure the can, if desired.

The flexible hose 16 is fluidly coupled by a quick disconnect coupling C to output hole 116 of the centrifugal pump 58. Paint contained in the paint can 130 is thus moved through the hose 16 by the pump 58 as indicated by arrows 72 in FIG. 1.

The frame 12 includes a main body 102 having a cylindrical projection 80 therewith which has a male member with external threads 82 for coupling the frame main body to the primary operating handle 280 directly, or through suitable extension poles of conventional construction. The couplings C are included at each end of hose 16 for allowing additional hose to be inserted for increasing the reach of the total hose, as well as a quick disconnect for clean-out purposes. The electric cord 20 is connected to an on/off switch 84 which is hermetically sealed in handle 280 by which operation of the motor 18 is controlled through a low voltage safety circuit.

Figure 9:
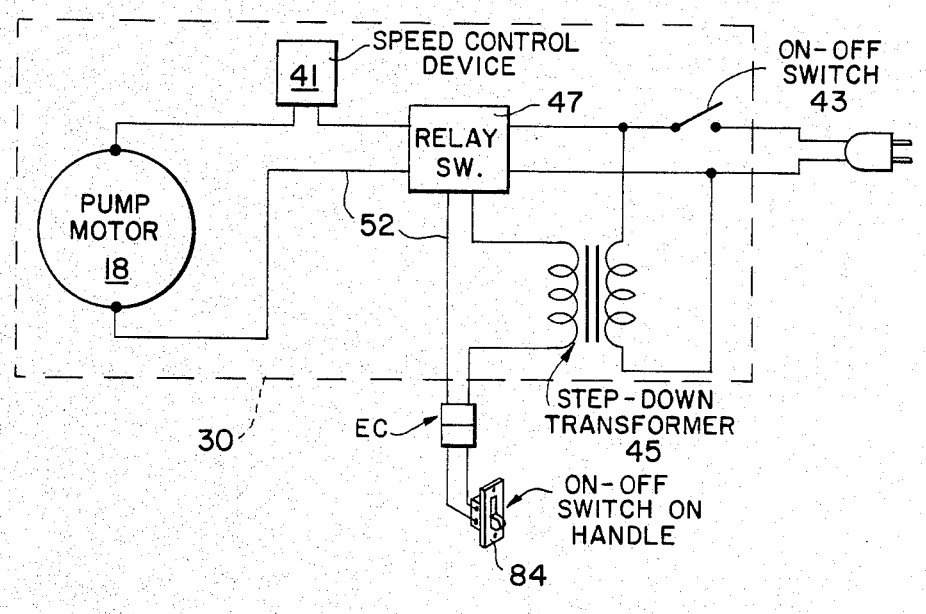
FIG. 9 is a schematic diagram of the low voltage motor control circuitry for safety of the movable paint supply base unit.

FIG. 9 shows a schematic diagram of the electrical wiring for the present invention. An on/off switch 43 connects the input plug to a conventional power main to the wiring as mounted inside of base unit housing 30. A 110 volt switch is actuated by a low voltage relay 47 and connects the main power voltage through a speed control device 41 to the pump motor 18. A stepdown transformer 45 provides a low voltage of 6 to 24 volts for energization of the relay switch 47. This energization is appropriately effected when desired by the on/-off switch 84 mounted on handle 280 and connected to the housing wiring by the electrical connector EC. Appropriate wiring 52 connects the elements aforedescribed. In summary, the on/off switch 84 controls the low voltage circuit for energization of the relay for the 110 volt pump motor switch, and in turn the speed control device can regulate the relative speed of the pump motor 18 as desired.

Looking at FIGS. 1, 2 and 3, the supports for the applicator roller 22 and the feed roller 24 will now be described in detail. The frame main body 102 with handle projection 80 supports both of tne rollers 22 and 24. Roller 22 is supported by a U-shaped frame 26 which has an elongated leg 126 for supporting conventional paint applicator roller frame structure thereon. Such conventional frame structure is designed to accommodate standard size rollers, i.e. seven or nine inches in width, which rollers can be easily replaced when desired with other conventional type rollers. The importance in this invention of using such conventional paint roller frame support construction is so that the owner and user of this device can easily obtain rollers at all hardware stores, drug stores, general utility stores and the like without any difficulty. A problem with many special applicator apparatus of known type is that special rollers are required and, therefore, the device may be out of use for lack of a suitable replacement paint roller.

The other extended leg of U-frame 26 is indicated in FIG. 1 by reference numeral 226 and is mounted through the entire width of frame main body 102. As seen in FIG. 3, the end 326 of rod 226 extends far enough outside of main body 102 to support a pivotable carriage 161 therefrom. Carriage 161 has end plates 160 at each side thereof for pivotable mounting upon elongated leg 226. Apertures 260 in end plates 160 are just slightly larger than elongated leg 226 to provide for this pivotable movement. A coil spring 162 at each end of the pivot carriage 161 biases this carriage towards applicator roller 22. Also, spring clips 133 are provided with the pivot carriage 161. These clips may be separate clips attached to the carriage 161 by welding or the like, or may be provided by punching and deforming same from the carriage irself. A handle 33 is also provided integral with pivot carriage 161. On the end of each side plate 160 opposite pivot hole 260 is a finger 164. These fingers 164 provide a circular recess 264, as best seen in FIG. 2, for supporting the idler feed roller 24 rotatably therewithin. The feed roller support structure relating to this will be described below.

The tilted U-shaped frame that holds the exterior paint roller 22 is as follows. The frame is set in the handle so as not to be in line with the handle. The reason for this is two-fold, the first being the use of a shield insert that can fit into a slot molded into the handle, thus eliminating a back bracket which is separate. The second reason is the built-in angle which holds the roller in a better position for applying paint at heights which have to be reached with extension handles, such as on high walls or ceilings.

Again looking at FIG. 2, the paint shield 31 can be seen in full lines as mounted within the spring clips 133. When the handle 33 is depressed against handle projection 80, this protective shield 31 will be swung down to the dotted line position as shown. In this dotted line position the feed roller support fingers 164 are in position for receiving the feed roller support ends therewithin. Also in this figure, a slot 110 which extends the width of main body 102 can be seen. In certain uses of the device, it is highly desirable that the paint shield 31 be relocated and placed in this slot 110. This slot 110 in conjunction with the spring clips 133 thus provides a multi-purpose use of the paint shield 31.

The position of the paint applicator roller 22 with respect to the body 102 is preferably positioned at approximately 15° from the centerline CL through the frame body 102 and handle projection 80 (see FIG. 2).

The idler feed roller 24 is rotatably mounted upon the pivot carriage 161 by the fingers 164 through use of slotted hex nut supports 96 and 98. These supports 96 and 98 are best seen in FIG. 4. Supports 96 and 98 are quite similar, though actually different. Support 96 has a threaded end 97 which will screw into one end of the feed roller 24. The other end of support 96 is provided with a hex nut 196 which has a slot 296 therearound. The inner surface of this slot is of round configuration and rests within the aperture 264 as provided by finger 164. Support 96 is provided with an enlarged recess 234 for receiving a ball bearing 134 therewithin. This ball bearing in turn receives a short coupling nipple 130 which provides the input for the fluid paint. A ridged outer end 133 of the nipple 130 receives the short fluid input hose 136 thereupon. The other support 98 is provided with a threaded end 99 for screwing and affixing to the other end of the feed roller 24. The other end of support 98 has a hex nut 198 thereon with a slot 298 therearound in a manner similar to that of slot 296 of the first support. However, in support 98, instead of having a feed through passage 148 in the center thereof, the support is solid and the outer end of the hex nut is provided with a screwdriver slot 498, as shown in FIG. 2

The feed roller 24 includes a tubular body 190 around which a porous covering sleeve 192 is mounted. A central fluid passage 200 extends longitudinally and axially through the feed roller body 190 and is fluidly connected to the fluid passage 148 in the slotted hex nut support 96 to be fluidly connected to the flexible hose 16 for fluid connection to the fluid source 14.

As described above, the coupling C as shown in FIG. 3, the short input hose 136, together with the nipple 130, provide fluid paint input into the fluid passage 148 of the hex nut support 96.

As shown in FIGS. 4, 5, 6 and 7, a plurality of fluid transfer passages 210, 212 and 214 are defined in the roller body to extend radially thereof and to have one end thereof fluidly connected to the fluid passage 200. The transfer passages extend from the fluid passage 200 to near the outer surface of the roller body 190.

Figure 7:
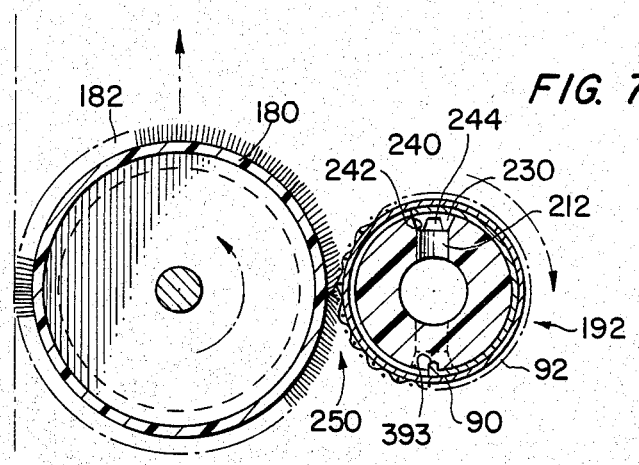
FIG. 7 is an elevational view in cross-section taken generally along line 7—7 of FIG. 3.

A pair of closed loop helical fluid troughs 230 and 232 are defined in the roller body 190 and are downwardly convergent in shape toward transfer passage outer end 242 (see FIG. 7).

As best shown in FIG. 4, the fluid troughs intersect each other at central transfer passage 212 and each have the outer ends thereof fluidly coupled together via outer transfer passages 210 and 214. The fluid troughs receive fluid from all of the transfer passages simultaneously. As best shown in FIG. 7, the troughs are depthwise constricting, and thus have a width dimension which decreases from a maximum at or near the topmost section thereof to a minimum at the bottom of each channel. A maximum width location on trough 230 is indicated by reference indicator 240 in FIG. 7, and a minimum width location is indicated by indicator 242 in that figure. A ridge 244 is also included in both fluid troughs 230 and 232. The ridges extend from fluid source to fluid source and establish a capillary action in the fluid troughs to produce an even point distribution.

FIGS. 4 and 6 show the deflector rings 91 and 93 as used with the feed roller 24. The feed roller body 190 is provided with reduced portions 191 at the respective ends thereof. These reduced portions 191 correspond with the outlets of the radial traverse passages 210 and 214, that is, where these passages input into the respective ends of the helical troughs 230 and 232. In order to assure that all of the fluid paint exiting from these radial fluid passages 210 and 214 flow as desired into the helical troughs, inserts 313 are provided in the respective passages. These inserts 313 are of flexible material and are semi-elliptical so that the outlet opening thereof will be toward the helical troughs. Then metal deflector sleeves 91 of complete ring configuration are slid over the recess ends 191 and abut the upper portion of inserts 313. Tnus, all fluid paint flowing out of traverse passages 210 and 214 will be diverted into the respective ends of the helical troughs. Similarly, a recess portion 193 is provided at the middle of the body 190 for covering the outer end of radial traverse passage 212. However, rather than using a solid sleeve like 91, a semi-circular sleeve 93 is used which can be sprung slightly apart to fit over the recess portion 193. A nut 293 on one end of semi-circular deflector sleeve 93 engages in a recess 393 in the body 190. This prevents the rotation of partial ring 93 and maintains the covering portion of the ring over the outlet of traverse passage 212. Recessed ends 195 receive the double seamed elastic ends 94 of the cover 92.

The deflection sleeves used at various points along grooved channels are to insure uniform pressure on all channel points.

However, instead of rings as shown, clips into the notches, or impervious tape, or inserts into the ports, or hollow screws that can be inserted into the ports with a side opening can be used, the purpose being to channel paint across the outside channels and to insure that pressure within such channels is kept even when placed at various spots along the channel or multi-closed loop channels. The present channels use a minimum number of traverse holes to supply paint into the exterior of a standard paint roller.

Figure 5:
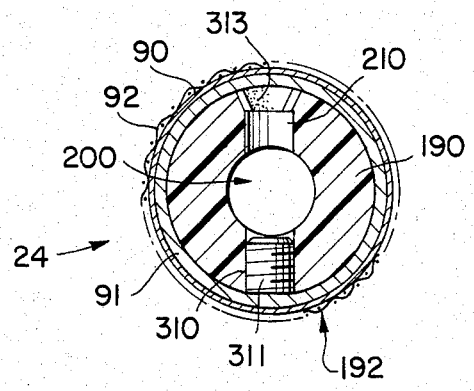
FIG. 5 is a cross-sectional view taken generally along line 5—5 of FIG. 4.

FIG. 5 shows a cleanout hole 310 opposite and in line with the radial transfer passage 210. A removable threaded plug 311 blocks this cleanout hole during normal use of the feed roller 24. However, when it is desired to clean the roller, the plug 311 for passage 210 and a similar plug for passage 214 can be removed for insertion of a cleaning tool.

Fluid from the source 14 is transferred to the surface of the idler feed roller 24 by passing through the porous covering 192 to be evenly applied to the covering 182 of the roller 22 for application to a suitable surface SS as best indicated by arrows AP in FIG. 2. Because of the helical shape of the fluid troughs, efficient transfer of fluid from the source to the roller 22 is effected. Contact between the rollers 22 and 24 is best shown in FIGS. 2 and 7 at contact point 250, and the pressure exerted at this contact point is relatively constant because of the bias of the roller 22 on pivoted carriage 161 relative to the roller 24 because of the springs 162. This pressure is preferably constant to insure a smooth, even application of paint to the applicator roller 22.

The fluid paint flow is adjusted by operating the on/off switch 84 to pump fluid into the hose 16, or to shut down such fluid paint movement. For example, the switch can be operated to pump fluid during the forward stroke of the unit 10, that is, a stroke moving the unit upward in FIG. 2, and to stop fluid flow during a rearward (downward) stroke. Other combinations can be used and still not depart from the scope of the present invention.

Actuation of the electric switch 84 activates the motor 18 which causes rotation or the centrifugal pump 58 to force fluid from the paint can 130 into the hose 16. The fluid paint moves from the hose 16 into the fluid passage 200 via fluid input hose 136. The fluid flows into the helical troughs 230 and 232 via the radial transfer passages 210, 212, 214 and then through the two-ply porous covering 192 on the roller 22 to be evenly applied to the covering 182 of the roller 22. Once on the roller covering 182, the fluid paint is evenly applied to whatever suitable surfaces the operator desires to paint.

Figure 10:
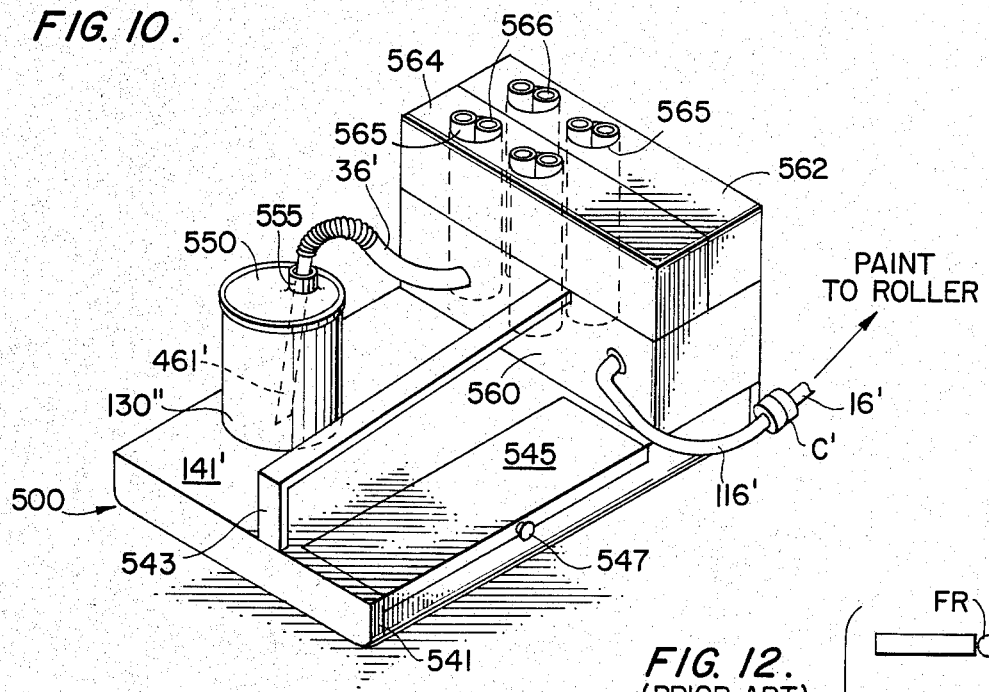
FIG. 10 is a perspective view of another embodiment of movable paint supply base unit.
Figure 11:
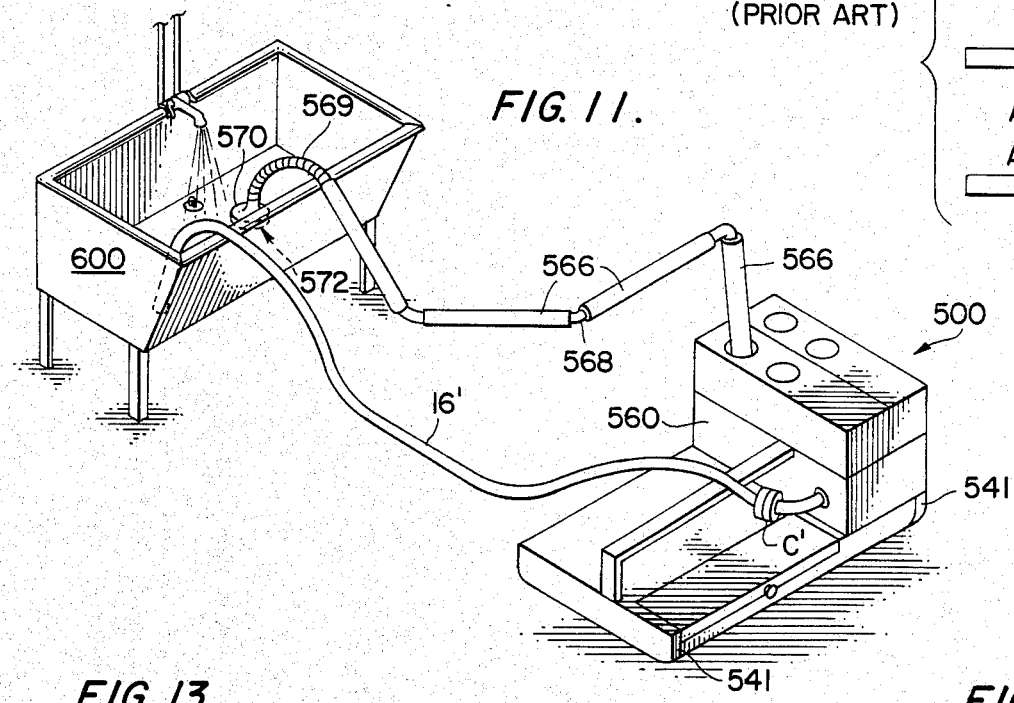
FIG. 11 is a perspective view depicting this embodiment in a clean-up operation.

FIGS. 10 and 11 of the drawings show a modified embodiment of the movable paint supply base unit with provision therewith to facilitate clean-up after a painting operation. In this embodiment a sled 500 is used for holding a paint supply can 130'', and the impeller pump and motor (not shown) within the compartment 560. A main support base 141' includes an L-shaped handle structure 543 and a compartment 560 with removable housing closures 562 and 564. Apertures 565 are used to store clean-up tubes 566 therein. The tubes 566 are suitably connected by flexible coupling joint hoses 568 and terminate at flexible line 569 feeding into a sink magnetic weight 570. This magnetic weight 570 is provided with suitable water intake ports 572 around the bottom thereof so that water can be sucked up from a sink 600 as shown in FIG. 11. Thus, water for cleaning out the lines and system of the pump unit can be inputted through tubes 566 into the pump within the unit. Skids 541 at the respective ends and along the bottom of the sled permit easy movability thereof. A compartment 545 having a handle 547 is also provided for containing paint roller heads and handles in a moisture wet condition. A quick connect/disconnect C' in the feed line 116' to 16' is also indicated.

Figure 12:
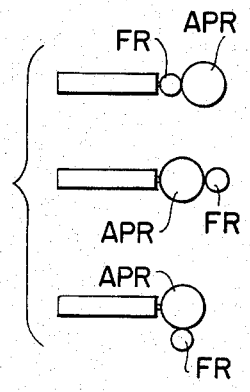
FIG. 12. (PRIOR ART)
FIG. 12 is a sketch of prior art applicator rollers.

Looking at FIG. 12, several known prior art devices are indicated schematically. If the feed roller FR is between the roller and the applicator paint roller APR, the overall structure of the applicator is complicated because of needing to adjust the bottom feed roller relative to the exterior applicator paint roller. Of course, the applicator paint roller can easily be used in this configuration in painting of any desired surface. Conversely, if the feed roller FR is at the top or outside of the exterior applicator paint roller opposite from the handle, this will prevent the applicator paint roller APR from working properly in all manner of operations because as you paint lower extremities of surfaces, the feed roller hits the wall before the applicator paint roller.

Similarly, if the feed roller is directly at right angles to the applicator paint roller, some blocking will occur and, of course, it will prevent the applicator paint roller from being used to apply paint from both sides. Therefore, none of these types of prior art devices offer the new and novel features of the present device.

Figure 13:
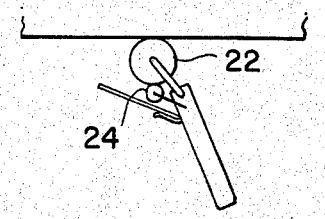
FIGS. 13–15 are sketches of the present invention as used for painting various surfaces.
Figure 14:
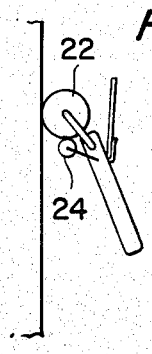
Figure 15:
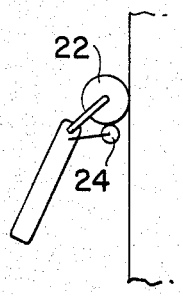

In the present invention, the feed roller 24 is less than a 45° angle from being at right angles to the applicator roller 22 so that as much as possible of the applicator paint roller is exposed for use. This, of course, allows the roller head of the present application to be reversed and the shield moved to the other side so that the roller head can be switched to paint close to walls on either side of a room. For example, when painting a ceiling as shown in FIG. 13, the feed roller 24 can be positioned as shown with, of course, the paint shield therebelow. In FIG. 14, a wall as shown on the left can be painted just as easily. Conversely, a wall on the right can also be painted without difficulty. By holding the handle of the device at an angle of 45° or greater, the paint roller can be used to work forward with very long sweeps. This can best be seen in the sketch of FIG. 13.

In FIG. 10, the paint can 130″ is shown as having mounted thereover a flexible paint can cover 550 having a raised aperture integral therewith for receiving the suction tube 461′ as flexibly connected ro the centrifugal impeller pump by hose 36′. This paint can cover obviously will function or prevent paint splashing if the base unit is moved during use of the device.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

We claim:

1. A paint applying apparatus comprising:
a frame;
an applicator roller mounted on said frame for applying paint to a surface;
a paint feed roller removably mounted on a pivotable carriage on said frame;
bias means normally holding the feed roller in engagement with said applicator roller;
said feed roller having dispensing means therewith for thoroughly and efficiently distributing paint thereacross;
a portable base unit;
power means with said base unit for supplying paint under relatively low pressure to said feed roller through a flexible connecting hose;
a handle removably attached to said frame having a switch thereon for remotely controlling energization of said power means for supplying paint; and
said dispensing means on said feed roller for thoroughly and efficiently distributing paint thereacross including a pair of closed loop helical troughs extending the working width of said feed roller.

2. A paint applying apparatus as set forth in claim 1, further including a central ridge in the center of each trough, and one end of each helical trough connecting with a radially extending fluid passage which is provided with a replaceable paint deflecting insert.

3. A paint applying apparatus as set forth in claim 2, further including paint deflecting sleeves over each replaceable paint deflecting insert at the respective trough ends of said feed roller.

4. A paint applying apparatus as set forth in claim 3, wherein said power means for supplying paint under relatively low pressure to said feed roller with said base unit includes means for holding at least one can of paint, an electric motor driven pump, a suction tube for input of paint to the pump, and discharge means for supplying paint under pressure to the flexible connecting hose.

5. A paint applying apparatus as set forth in claim 1, wherein said power means for supplying paint under relatively low pressure to said feed roller with said base unit includes means for holding at least one can of paint, an electric motor driven pump, a suction tube for input of paint to the pump, and discharge means for supplying paint under pressure to the flexible connecting hose.

6. A paint applying apparatus as set forth in claim 5, wherein said means for holding at least one can of paint includes support structure for supporting the can of paint in tilted manner so that said suction tube can withdraw substantially all of the paint from within the paint can during operation of the device.

7. A paint applying apparatus as set forth in claim 6, further including an on/off switch, wiring from said electric motor driven pump to a flexible electric cable with plug for insertion into a conventional 110 volt power main, a relay switch in series with this wiring and operated through a stepdown transformer supplying low voltage power for energization thereof, said low voltage circuit being controlled by said switch on the handle for maximum safety of the user of the apparatus.

8. A paint applying apparatus as set forth in claim 7, wherein said electrical wiring further includes a speed control device to vary the operating speed of the pump electric motor during actual painting as well as during cleanup.

9. A paint aplying apparatus as set forth in claim 8, said feed paint roller being provided with removable end support structures for rotatably supporting it on said pivotable carriage and permitting easy replacement thereof when needed, a fluid paint input through one of said end support structures, and a replaceable two-ply cover for said feed roller having a fine mesh inner layer and a coarse mesh outer layer which are secured together, and at the respective ends thereof elastic means for securely holding said cover on said feed roller by indented recesses as provided at each end thereof.

10. A paint applying apparatus as set forth in claim 9, further including a changeable paint shield mountable upon either the pivotable carriage for the feed roller or the frame of the applicator apparatus.

11. A paint applying apparatus as set forth in claim 10, further including quick connect/disconnect fittings provided at each end of said flexible connecting hose which is made of transparent material so that the flow of paint therethrough can be easily viewed by an operator during use, and also so that the flexible tubing can be quickly separated from the portable base unit and the applicator apparatus upon completion of use of the apparatus.

12. A paint applying apparatus as set forth in claim 11, wherein said removable handle having the switch thereon can be separated from the applicator roller frame and suitable extensions inserted therebetween for greatly extending the overall operating length of the apparatus.

13. A device for applying paint comprising: a main frame body, a projection extending therefrom for receiving a handle, a U-shaped support attached to said frame body for holding a standard size paint applying roller, a support carriage pivotably mounted on said main frame body, a paint feed roller removably supported on said support carriage, means to normally bias the support carriage so that the feed roller is in contact with the paint applying roller, a base unit, means on said base unit for holding at least one can of paint in a desired position, power means for feeding paint from said paint can to the feed roller under relatively low pressure, and a control for said power means mounted on said handle so an operator can accurately and efficiently control paint flow during use of the device, and said feed roller having dispensing means therewith for thoroughly and efficiently distributing paint thereacross including a pair of closed loop helical troughs extending the working width of said feed roller, and each trough further including a central ridge longitudinally along the center thereof.

14. A paint applying device as set forth in claim 13, wherein said U-shaped support for the paint applying roller is mounted at an angle of approximately 15° from a centerline through the main frame body and the handle projection.

15. A paint applying device as set forth in claim 14, wherein said feed roller is covered with a two-ply sleeve having a fine mesh inner layer, a coarse mesh outer layer, and elastic means at each end thereof for replaceably retaining said sleeve in place on the feed roller.

16. A paint applying device as set forth in claim 13, wherein said feed roller is covered with a two-ply sleeve having a fine mesh inner layer, a coarse mesh outer layer, and elastic means at each end thereof for replaceably retaining said sleeve in place on the feed roller.

17. A paint applying device as set forth in claim 13, further including a detachable paint shield mountable on either the feed roller support carriage or the main frame body depending on how the device is to be used.

18. A paint applying device as set forth in claim 13, wherein said power means for feeding paint from said base unit to the feed roller includes a 110 volt alternating current electric motor driving a impeller centrifugal pump having flexible impeller blades, a cam obstruction within said pump engageable by said flexible impeller blades so that paint can be flowed efficiently at relatively low pressure from the pump, and low voltage control means connected in the circuit for said pump electric motor so that an operator can use said control mounted on the apparatus handle safely and efficiently without danger of shock or electrocution.

19. A paint applying device as set forth in claim 16, wherein a low voltage circuit having a stepdown transformer, a low voltage actuation relay switch for connecting said electric motor to the power mains, and a variable speed motor control are, all mounted within said movable base unit for maximum portability.

20. A paint applying device as set forth in claim 13, wherein one end of each helical trough connects with a radially extending fluid passage which is provided with a replaceable paint deflecting insert, and the other end of each helical trough connects with a common radially extending fluid passage.

21. A paint applying device as set forth in claim 20, further including paint deflecting sleeves over each replaceable paint deflecting insert near the respective outer ends of said feed roller, and a partial sleeve with retention nub over the common radially extending fluid passage midway of said feed roller.

22. A paint applying device as set forth in claim 13, wherein said base unit includes a platform having at least two skid members along the bottom thereof for ease of movement of same across a floor, an L-shaped handle to assist in moving said base unit, a compartment provided for holding said power means and also clean-out tools in apertures provided therein, and flexibly connected clean-out tubing stored within said apertures.

23. A paint applying device as set forth in claim 22, wherein a sink magnetic weight having water intake ports therewith is connected to the pickup end of said cleanout tubing for mounting within a sink during a clean-up operation.

24. A paint applying device as set forth in claim 23, wherein a paint supply can held upon said base unit is supplied with a plastic paint can cover thereover after the paint can has been opened, and said plastic paint can cover has a raised aperture integrally therewith for receiving a flexibly connected suction input tube therethrough.

* * * * *